US005848741A

United States Patent [19]

Fair

[11] Patent Number: 5,848,741

[45] Date of Patent: Dec. 15, 1998

[54] SOFT-SIDED INFANT CARRIER WITH CANOPY

[75] Inventor: Paul F. Fair, Denver, Colo.

[73] Assignee: Evenflo Company, Inc., Vandalia, Ohio

[21] Appl. No.: 736,804

[22] Filed: Oct. 25, 1996

[51] Int. Cl.[6] ..... A61G 1/00

[52] U.S. Cl. ..... 224/160; 224/186; D3/214

[58] Field of Search ..... 224/158, 159, 224/160, 161, 186, 190

[56] References Cited

U.S. PATENT DOCUMENTS

| | | | |
|---|---|---|---|
| D. 132,469 | 5/1942 | Murphy . | |
| D. 253,558 | 12/1979 | Carter . | |
| D. 277,811 | 3/1985 | Moore . | |
| D. 324,607 | 3/1992 | Nelson . | |
| D. 332,175 | 1/1993 | Beplate . | |
| D. 357,800 | 5/1995 | Roan et al. | D3/214 |
| D. 370,996 | 6/1996 | Shimura et al | D3/214 |
| 2,376,657 | 5/1945 | Chamberlain . | |
| 2,411,331 | 11/1946 | Nettleship . | |
| 2,628,358 | 2/1953 | Neils | 2/69.5 |
| 3,481,517 | 12/1969 | Aukerman . | |
| 3,780,919 | 12/1973 | Hansson | 224/160 |
| 4,037,764 | 7/1977 | Almonsino et al. . | |
| 4,166,558 | 9/1979 | Schroeder | 224/158 |
| 4,333,591 | 6/1982 | Case | 224/160 |
| 4,389,005 | 6/1983 | Cable et al. | 224/159 |
| 4,402,440 | 9/1983 | Purtzer et al. | 224/160 |
| 4,428,514 | 1/1984 | Elf | 224/151 |
| 4,434,920 | 3/1984 | Moore | 224/160 |
| 4,436,233 | 3/1984 | Hill et al. | 224/159 |
| 4,467,945 | 8/1984 | Schaapveld | 224/160 |
| 4,579,264 | 4/1986 | Napolitano | 224/160 |
| 4,717,056 | 1/1988 | Carmichael | 224/158 |
| 4,923,104 | 5/1990 | Rice et al. | 224/160 |
| 4,986,458 | 1/1991 | Linday | 224/160 |
| 5,011,057 | 4/1991 | Perruzza et al. | 224/158 |
| 5,020,709 | 6/1991 | Hoaglan | 224/151 |
| 5,071,047 | 12/1991 | Cordisco | 224/158 |
| 5,178,309 | 1/1993 | Bicheler et al. | 224/160 |
| 5,205,450 | 4/1993 | Derosier | 224/161 |
| 5,205,451 | 4/1993 | Manzer | 224/161 |
| 5,222,641 | 6/1993 | Medeiros, Jr. | 224/161 |
| 5,246,152 | 9/1993 | Dotseth | 224/159 |
| 5,333,769 | 8/1994 | Skroski | 224/158 |
| 5,361,952 | 11/1994 | Gold | 224/159 |
| 5,441,186 | 8/1995 | Halligan | 224/159 |
| 5,454,498 | 10/1995 | Dunn et al. | 224/160 |
| 5,490,620 | 2/1996 | Bergqvist | 224/160 |
| 5,492,256 | 2/1996 | Ive | 224/159 |
| 5,522,528 | 6/1996 | Petricola | 224/160 |
| 5,570,823 | 11/1996 | Lindy | 224/160 |
| 5,609,279 | 3/1997 | O'Shea | 224/160 |
| 5,692,655 | 12/1997 | Fair et al. | 224/160 |

*Primary Examiner*—Allan N. Shoap
*Assistant Examiner*—Gregory M. Vidovich
*Attorney, Agent, or Firm*—Robert G. Crouch; Holland & Hart LLP

[57] ABSTRACT

A frameless infant carrier which includes a canopy provided thereon. The carrier also includes a pouch for containing the infant and a pair of shoulder straps attached to the pouch for supporting the infant on the shoulders of the wearer. The canopy is suspended from a position on the pouch behind the infant to central positions on each of the shoulder straps. The canopy may be composed of a breathable, mesh material and may be selectively attachable to and removable from the shoulder straps via buckles. A pocket is defined in the back of the pouch to contain and store the canopy when not in use.

14 Claims, 4 Drawing Sheets

SOFT-SIDED INFANT CARRIER WITH CANOPY

The present invention relates to an improved design for a soft-sided infant carrier and, more particularly, to an infant carrier which includes a canopy thereon for protecting the infant from various environmental elements.

BACKGROUND OF THE INVENTION

Shoulder-supported infant carriers are well-known, including a plethora of designs and styles which have been used for both front carriers and back carriers. Such infant carriers allow the adult wearer to carry the infant while performing other activities including hiking, shopping, attending outdoor events, amusement parks, or zoos, etc. One characteristic common to many of these activities is that they are outdoor activities.

One disadvantage common to almost all carriers is that there is little or no protection from the environmental elements encountered in outdoor activities, such as sun, wind, rain, and snow. Certain infant carriers, however, have been intended to provide certain types of protection with limited success. A first type of design intended to at least partially protect the infant from the elements includes a fabric flap or shield extending out (without support) from the top or sides of the infant carrier to at least partially protect the head and face of the infant. Unfortunately, many of these shields are not large enough to adequately protect the face and head of the infant and, further, they may not protect the infant from elements such as sun or rain which can come toward the infant at an angle other than directly vertically above the infant. In addition, such fabric or soft plastic shields are easily moved out of position by the baby, by the wearer (accidentally), by the wind, etc.

Another type of design which is intended to provide some protection for the head of the infant includes a hood which is connected to the infant carrier to cover the head of the wearer. Unfortunately, such hoods leave the face of the wearer exposed. In addition, in warm weather, such hoods retain too much heat therewithin and are uncomfortably hot to wear for the infant.

It is against this background, and the desire to solve the problems of the prior art, that the present invention has been developed.

SUMMARY OF THE INVENTION

Accordingly, it is an object of the present invention to provide a soft-sided infant carrier which adequately protects the infant's face and head from environmental elements.

It is also an object of the present invention to provide a well-supported canopy for a soft-sided infant carrier.

It is further an object of the present invention to provide a self-supported canopy for a soft-sided infant carrier which does not include a frame with its inherent cost and weight drawbacks.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to a frameless infant carrier for carrying and supporting an infant on the body of an adult-sized wearer. The carrier includes an infant support adapted for receiving an infant, a pair of shoulder straps connected to the infant support, the straps being adapted for encircling the shoulders of the wearer, and a canopy selectively connected between the infant support and at least one of the shoulder straps to provide protection for the infant from adverse elements.

The support may be shaped and connected to the shoulder straps in an orientation for carrying the infant in a substantially vertical position. The canopy may be connected to the support in a manner which allows the canopy to extend from a location substantially at the top of the support and on the other side of the infant from the wearer. The infant support may include a fabric pouch, which may include a head bolster formed along an upper edge thereof. The pouch may include a compartment defined therein along a back side and below the head bolster, wherein the canopy is attached to the back side of the pouch, and wherein the compartment is adapted to selectively receive the entire canopy therein when the canopy is not in use. The head bolster may have an opening defined therein, wherein the canopy is attached to the pouch at a location inside said opening, and said opening is adapted to selectively receive the entire canopy therein when the canopy is not in use. The pouch may include a back side with a compartment defined therein, wherein the canopy is attached to the back side of the pouch, and wherein the compartment is adapted to selectively receive the entire canopy therein when the canopy is not in use. The weight of the infant in the carrier being centered at a location horizontally displaced from the wearer's shoulders may cause the pouch to pivot away from the wearer so as to place the canopy in tension between the shoulder straps and the pouch.

The present invention is also directed to a method of suspending a canopy over an infant in a frameless infant carrier which is used for carrying and supporting an infant on the body of an adult-sized wearer, the carrier including an infant support and pair of shoulder straps attached thereto. The method includes the steps of placing the carrier on the wearer, placing the infant on the infant support, and attaching the canopy between the pouch and the shoulder straps so that the weight of the infant causes the infant support to pull the canopy away from the shoulder straps and hold the canopy in a substantially-extended position.

The present invention is further directed to a frameless infant carrier for carrying and supporting an infant on the body of an adult-sized wearer. The carrier includes a fabric pouch adapted for receiving an infant, the pouch having a front side and a back side, the back side having an upper portion thereof. The carrier also includes a pair of shoulder straps connected at either end to the pouch, the straps being adapted for encircling the shoulders of the wearer and for maintaining the pouch in a position in which the infant is supported in a substantially-vertical position. The carrier further includes a canopy having first and second opposed edges, the canopy being attached along the first edge to the upper portion of the back side of the pouch and the canopy being selectively and removably attachable along the second edge to the shoulder straps.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figures 1, 10:
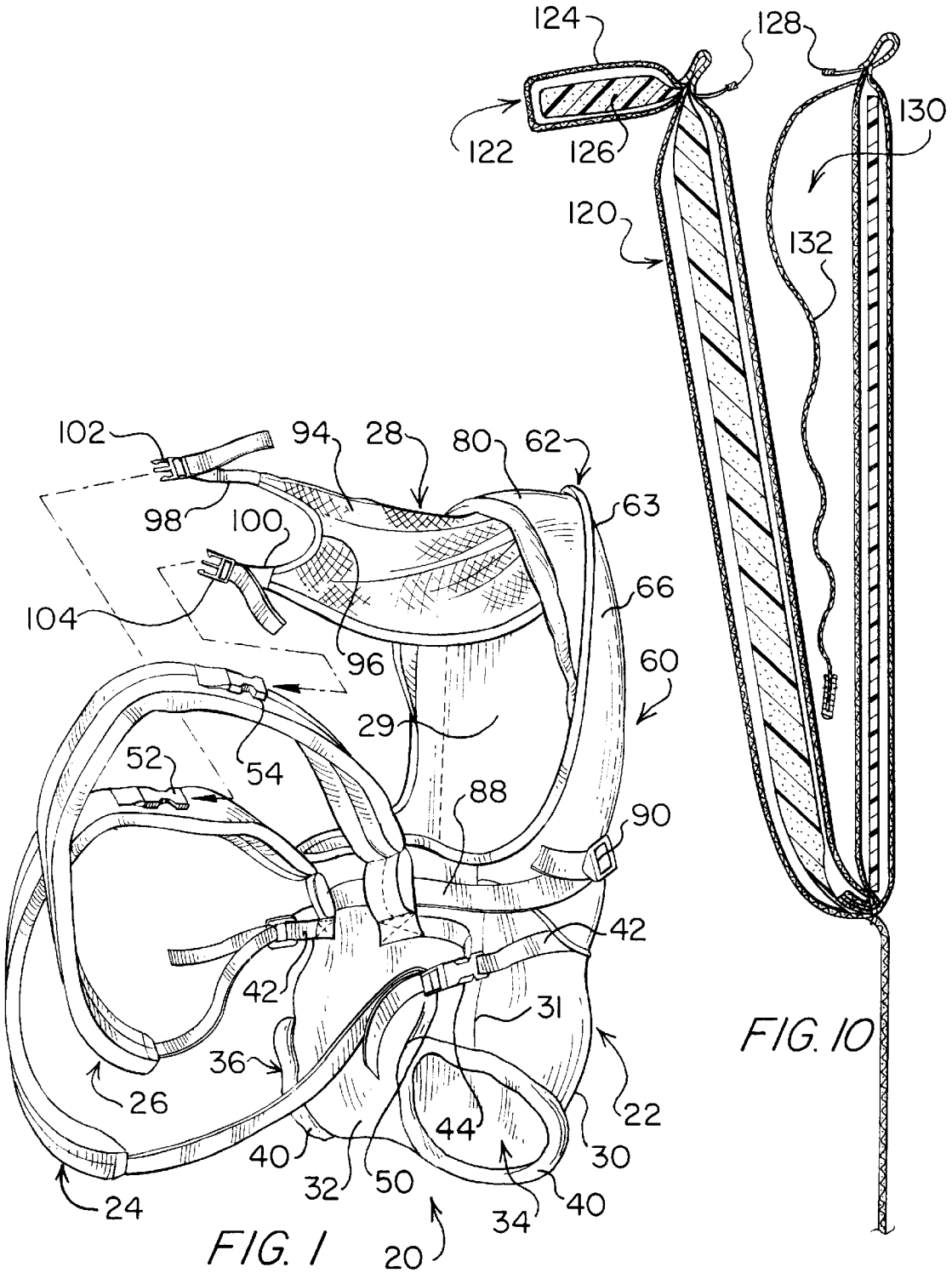
FIG. 1 is a perspective view of a soft-sided infant carrier with canopy of the present invention, shown without an infant in the carrier.
FIG. 10 is a cross-sectional view taken substantially along line 10—10 of FIG. 9, showing a pocket into which a canopy can be stored.

A soft-sided infant carrier 20 (FIG. 1) includes a fabric pouch 22 for carrying an infant 23, a pair of shoulder straps 24 and 26 attached to the pouch 22 for supporting the pouch 22 and infant 23 on the shoulders of a wearer 27, and a canopy 28 extendable between the pouch 22 and the shoulder straps 24 and 26 to protect the infant 23 from adverse elements.

The pouch 22 includes a fabric panel 29 folded over and stitched to itself to form a back seat portion 30, a front seat portion 32, and a first back panel 33. The back and front seat portions 30 and 32 are shaped so that when stitched together along side seams 31, a pair of leg openings 34 and 36 are defined therebetween. Preferably, each leg opening 34 and 36 is bordered by a padded, fabric binding 40 stitched thereto for comfort, reinforcement, and durability purposes. The shoulder straps 24 and 26 are stitched to the front seat portion 32 at spaced-apart, horizontally-aligned positions, as seen best in FIG. 1. A pair of webbed, horizontal straps 42 are each stitched at opposite ends thereof to the front and back seat portions 30 and 32, one of the straps 42 being positioned vertically above and just adjacent the leg opening 34 and one being positioned similarly relative to the leg opening 36. Each horizontal strap 42 has a buckle 44 slidably attached thereto, so as to be able to slide back and forth between the stitched ends of the strap 42. The shoulder straps 24 and 26, being attached along one end to the front seat portion 32 of the pouch 22, are attached at an opposite end to the pouch 22 via a buckle 50 on each strap 24 and 26 which matingly engages with the buckle 44 on the horizontal strap 42. Located at an intermediate position along shoulder straps 24 and 26 are a pair of female portions of buckles 52 and 54, one on each strap.

The shoulder straps 24 and 26 are adjustable in their effective length by manipulating each strap 24 and 26 relative to the buckle 50 located at an end of each strap. By manipulating these straps to effectively lengthen or shorten the shoulder belts, the shoulder belts can be adjusted relative to the torso size of the wearer 27.

A back support panel assembly 60 includes and is stitched to the first back panel 33 of the fabric panel 29 to complete the pouch 22. The back support panel assembly 60 includes four layers of fabric panels (including the first back panel 33) which together serve to define pockets therebetween. A head bolster 62 is stitched to the back support panel assembly 60 along a top edge 63 thereof to further protect the infant 23 and to provide an added feeling of security and closeness resulting from surrounding the infant 23 with material.

Figure 6:
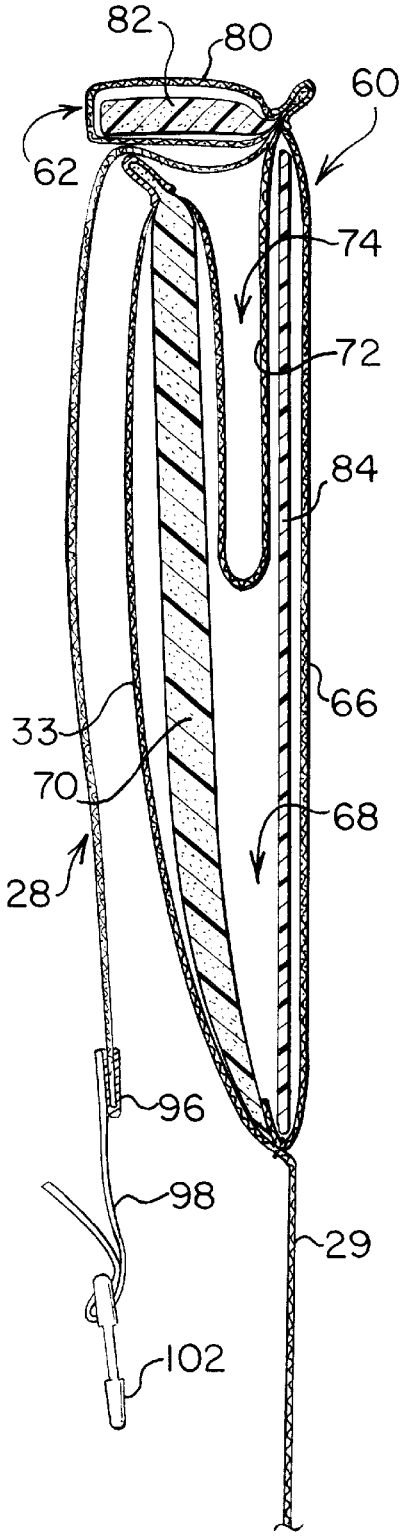
FIG. 6 is a cross-sectional view taken substantially along line 6—6 of FIG. 5, showing a pocket into which the canopy can be stored.

As seen in FIG. 6, the back support panel assembly 60 includes the first back panel 33 stitched at the bottom and sides to a second fabric back panel 66. A first pocket 68 is defined between the first and second back panels 33 and 66. Padding 70 is received within the first pocket 68 so as to provide a padded surface adjacent the infant 23. Also located within the first pocket 68, between the padding 70 and the second fabric panel 66, is a polyboard stiffener 84 to stiffen and limit the bendable nature of the otherwise soft-sided materials of the back support panel assembly 60. When an infant 23 is placed in the carrier 20, the polyboard stiffener 84 becomes curved in a shape which is a portion of an elongated cylinder (the longitudinal axis of the cylinder being parallel to the longitudinal axis of the carrier 20 and the infant 23 therein). The polyboard stiffener 84 has the characteristic that when curved in this fashion (i.e., about a particular axis), it is very difficult to simultaneously curve the stiffener about a second orthogonal axis. Thus, it is very unlikely that the stiffener would bend or curve backward to allow the infant 23 to pivot further away from the body of the wearer 27.

Figure 4:
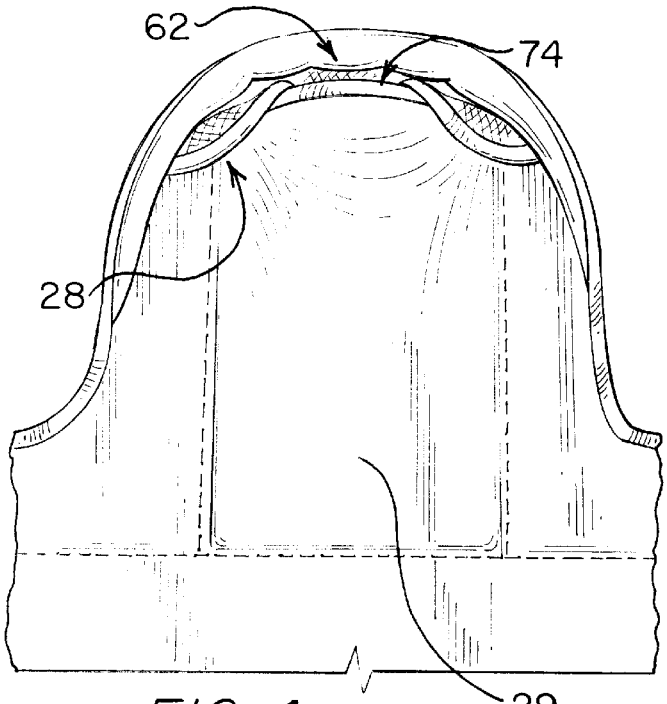
FIG. 4 is a front view of a portion of the infant carrier of FIG. 1, showing a back support panel of the carrier.
Figure 5:
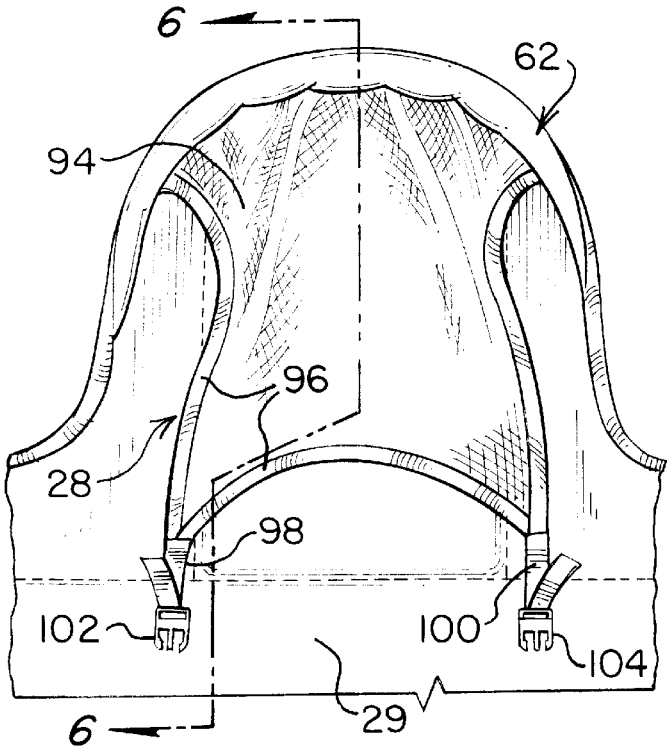
FIG. 5 is a view similar to FIG. 4, in which the canopy is shown attached to an upper portion of the back support panel.

A pocket panel 72 is folded in half, placed in the first pocket 68, and stitched on opposite sides thereof to form an open pocket 74 in the first pocket 68. The open pocket 74 is open at the top and is operative to selectively receive the canopy 28. The placement of the pocket panel 72 in the first pocket 68 serves to enclose the pocket 68 and thus contain the padding 70 and the stiffener 84. The open pocket 74 is held into a normally closed position by the close proximity of the head bolster 62 to the opening of the open pocket 74 and due to the tilted nature of the head bolster 62 when stitched to the back support panel assembly 60, as shown in FIG. 4.

The first and second fabric panels 33 and 66 extend laterally of the side seams of the pockets 68 and 74, and are stitched together along upper and lower edges thereof. Along the lower edge thereof, the second panel 66 of the back support panel assembly 60 is stitched to the upper edge of the back seat portion 30.

The head bolster 62 includes a panel of fabric 80 doubled over on itself and enclosing a strip of padding 82 therein. The head bolster 62 is stitched to the back support panel assembly 60 along the previously described upper edge of the second fabric panel 66. The head bolster 62 also extends laterally of the side seams of the pockets 68 and 74.

In order to further support the infant 23 and the back support panel assembly 60, an adjustable strap 88 is attached to the back support panel assembly 60 at a position which corresponds to the middle or upper back portion of the infant 23. The adjustable strap 88 loops around the pouch 22 from the back support panel assembly 60 through two loops formed between each of the shoulder straps 24 and 26 and the front seat portion 32 to connect with itself via a buckle 90 on the adjustable support strap 88. The adjustable support strap 88 can thus be manipulated relative to the buckle 90 to shorten or lengthen the strap and thus vary the distance of the back support panel assembly 60 from the chest of the wearer 27.

The canopy 28 is stitched along one side thereof to the top of the second fabric panel 66 of the back support panel assembly 60 along the seam where the head bolster 62 is also attached. The stitched edge of the canopy 28 extends laterally of both sides of the side seams where the fabric panels 33 and 66 are stitched together. The canopy 28 includes a mesh panel 94 surrounded by fabric binding 96 at the border thereof. A pair of straps 98 and 100 are stitched to the binding, one each at opposite ends of an edge of the canopy 28 opposite from that stitched to the back support panel assembly 60. The straps 98 and 100 terminate at male ends of buckles 102 and 104 which matingly engage with the female ends of buckles 52 and 54 located on shoulder straps 24 and 26.

Figure 2:
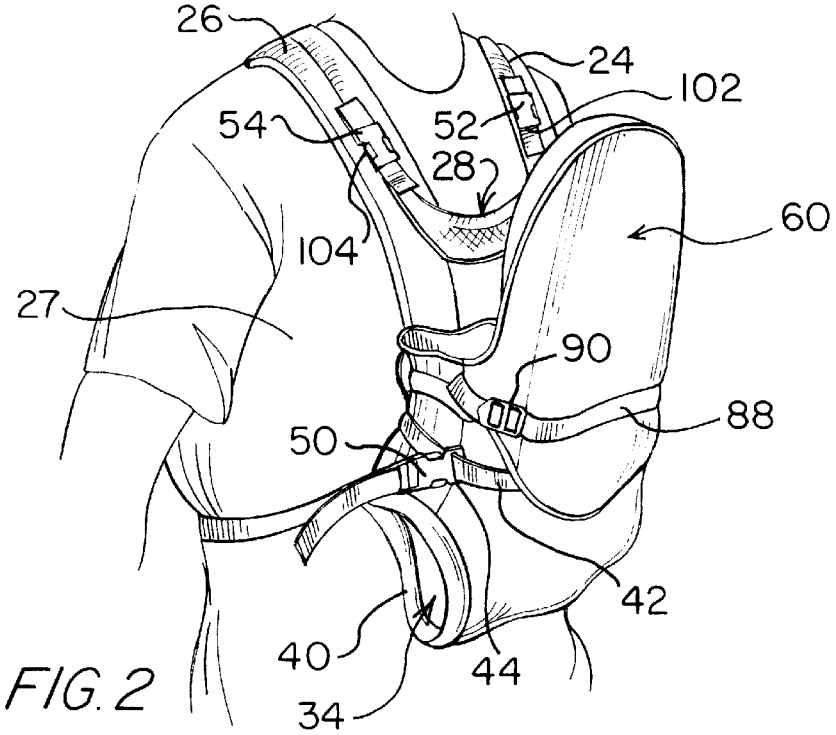
FIG. 2 is a perspective view of the soft-sided infant carrier of FIG. 1, shown on an adult wearer, in which the canopy is drooped since the carrier is empty.
Figure 3:
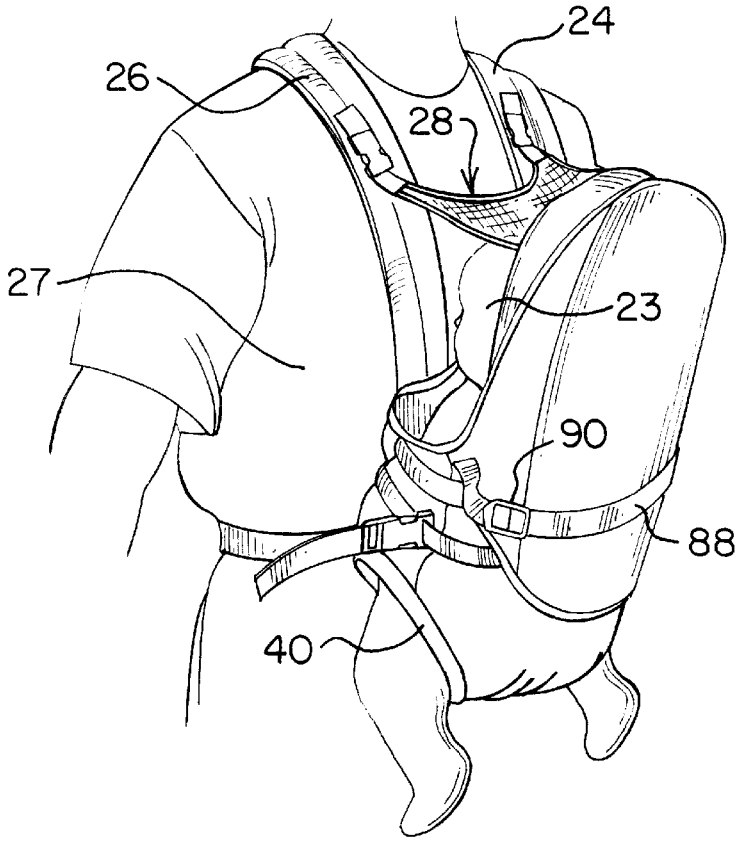
FIG. 3 is a perspective view similar to FIG. 2, in which the canopy is in an extended position due to the presence of an infant in the carrier.

When the carrier 20 is worn by the wearer 27 and no infant 23 is in the carrier 20, the canopy 28 will tend to droop into the position shown in FIG. 2. When an infant 23 is placed into the carrier 20, the canopy 28 will be pulled into an extended position, as shown in FIG. 3, due to the weight of the infant 23 being horizontally offset from the supporting point of the shoulder straps 24 and 26 on the shoulders of the wearer 27. This horizontal offset and the connection of the pouch 22 to the shoulder straps 24 and 26 at the bottom of the pouch 22, causes a force couple in which the mass of the infant 23 tends to pivot down and away from the wearer 27 to the extent allowed by the adjustable support strap 88 and the polyboard stiffener 84. The canopy 28 is thus a free-hung canopy working on tension derived from the weight of the occupant and does not rely on a frame for supporting the canopy 28.

As desired, the canopy 28 can be disconnected from the buckles 52 and 54 on the shoulder straps 24 and 26 (as shown in FIG. 1) and the canopy 28 can be stuffed back into the open pocket 74 in the back support panel assembly 60 of the carrier 20. Of course, the mesh panel 94 of the canopy 28 could easily be replaced with a solid fabric panel or even a waterproof panel, as desired.

Figure 7:
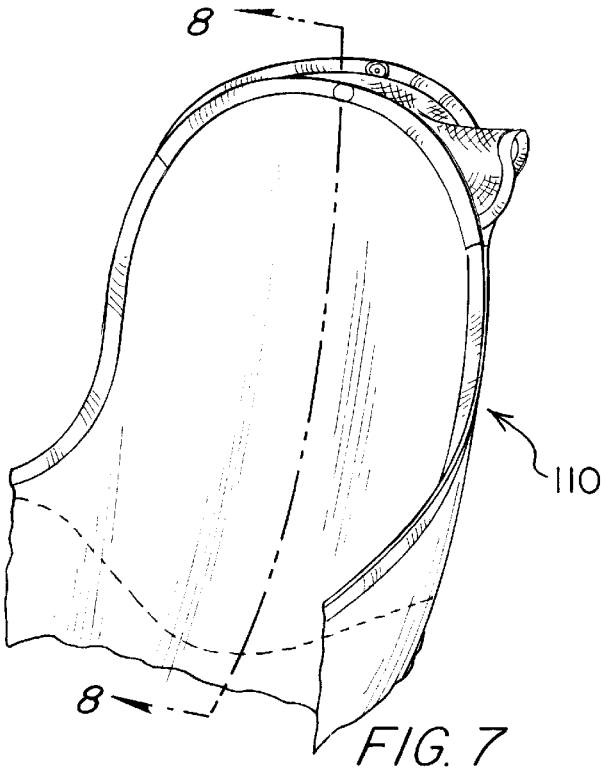
FIG. 7 is a perspective view of a second embodiment of a back support panel of the soft-sided infant carrier of the present invention.
Figure 8:
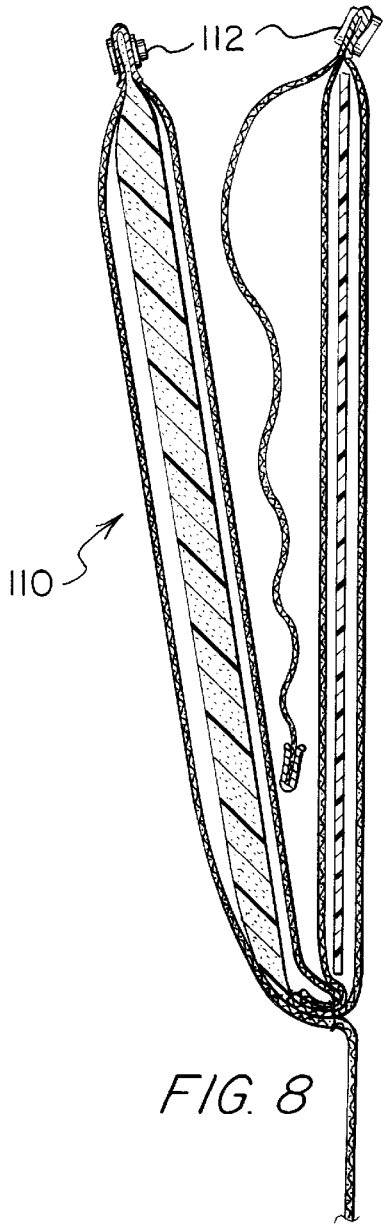
FIG. 8 is a cross-sectional view taken substantially along line 8—8 of FIG. 7, showing a pocket into which a canopy can be stored.

A second embodiment of a soft-sided infant carrier includes a back support panel assembly 110, as shown in FIGS. 7 and 8. This back support panel assembly 110 is similar to the back support panel assembly 60 discussed above, with the important distinction that the open pocket is held in a closed position by mating portions of a snap closure 112. The snap closure 112 can be fastened or unfastened as desired to store the canopy or to remove the canopy from the pocket so as to place it in an operable or extended position.

Figure 9:
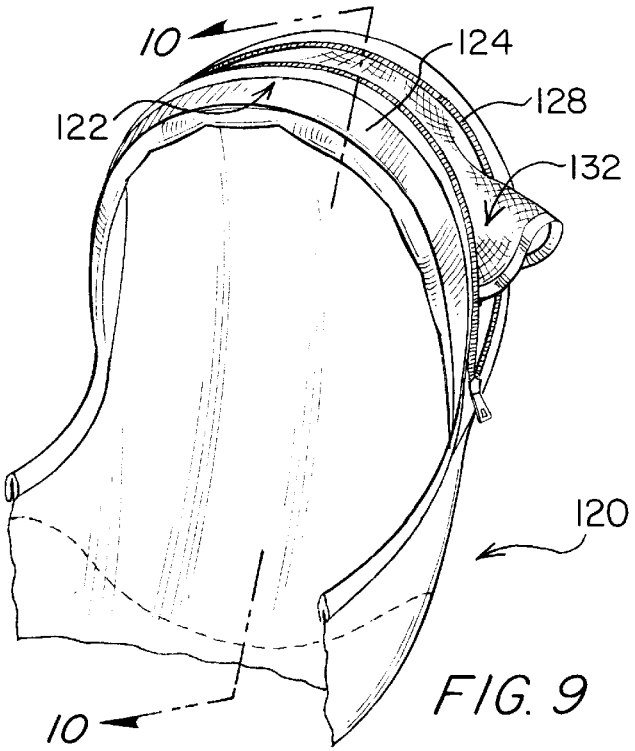
FIG. 9 is a perspective view of a third embodiment of a back support panel of the soft-sided infant carrier of the present invention.

A third embodiment of a soft-sided infant carrier includes a back support panel assembly 120, as shown in FIGS. 9 and 10. In this back support panel assembly 120, the head bolster 122 includes a fabric panel 124 and padding 126 and a zipper 128, which allows for access in and out of a pocket 130 defined by the fabric panel 124 which is folded back on itself. The canopy 132 can be stored within the pocket 130 or extended therefrom so as to place it into an operable position.

It can be appreciated that there are a variety of means for connecting the canopy to the infant carrier 20 and to the shoulder straps 24 and 26. As can be appreciated, buckles, snaps and seams can be interchangeably substituted as well as such other equivalents as velcro fastening devices, buttons, etc. In addition, any of the fabric panels could include a mesh fabric to provide a more breathable surface adjacent the wearer 27 and/or the infant 23.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The invention claimed is:

1. A frameless infant carrier for carrying and supporting an infant on the body of an adult-sized wearer, comprising:

an infant support adapted for receiving an infant and defining an infant compartment therein, the infant support including a rear portion thereof that is located on the opposite side of the infant from the wearer;

a pair of shoulder straps connected to the infant support, the straps being adapted for encircling the shoulders of the wearer; and a canopy having opposed edges, one of the edges being attachable to the infant support adjacent an upper edge of the rear portion and the opposite edge having attachment members attachable at one end thereto and attachable at an opposite end to the shoulder straps, for selective connection between the infant support and at least one of the shoulder straps to place the canopy in position above the infant compartment to provide protection for the infant from adverse elements, the canopy being supported between the opposed edges by the force of the infant in the infant support pulling the infant support away from the shoulder straps;

wherein the rear portion remains in an extended position when the infant support is supporting the infant so that the upper edge of the rear portion is above the head of the infant and keeps the canopy off of and above the head of the infant.

2. A frameless infant carrier as defined in claim 1, wherein said support is shaped and connected to the shoulder straps in an orientation for carrying the infant in a substantially vertical position.

3. A frameless infant carrier as defined in claim 2, wherein the canopy is connected to the support in a manner which allows the canopy to extend from a location substantially at the top of the support and on the other side of the infant from the wearer.

4. A frameless infant carrier as defined in claim 3, wherein said infant support includes a fabric pouch.

5. A frameless infant carrier as defined in claim 4, wherein the pouch includes a head bolster formed along an upper edge thereof.

6. A frameless infant carrier as defined in claim 5, wherein said pouch includes a compartment defined therein along a back side and below the head bolster, wherein the canopy is attached to the back side of the pouch, and wherein the compartment is adapted to selectively receive the entire canopy therein when the canopy is not in use.

7. A frameless infant carrier as defined in claim 4, wherein the pouch includes a compartment defined along a back side thereof, wherein the canopy is attached to the back side of the pouch, and wherein the compartment is adapted to selectively receive the entire canopy therein when the canopy is not in use.

8. A frameless infant carrier as defined in claim 1, wherein said infant support includes a fabric pouch.

9. A frameless infant carrier as defined in claim 1, wherein the weight of the infant in the carrier being centered at a location horizontally displaced from the wearer's shoulders causes the infant support to pivot away from the wearer so as to place the canopy in tension between the shoulder straps and the infant support.

10. A frameless infant carrier as defined in claim 1, wherein the rear portion includes a stiffening member to allow the rear portion to remain in an extended position when the infant support is supporting the infant so that the upper edge of the rear portion is above the head of the infant and keeps the canopy off of and above the head of the infant.

11. A method of suspending a canopy over an infant in a frameless infant carrier which is used for carrying and supporting an infant on the body of an adult-sized wearer, the carrier including an infant support and pair of shoulder straps attached thereto, the infant support including a rear portion with a stiffening member to maintain the infant support in a substantially extended position when the infant is in the infant carrier, the rear portion helping to define an infant compartment in the infant support, the method comprising the steps of:

placing the carrier on the wearer;

placing the infant in the infant compartment of the infant support; and attaching the canopy between the rear portion and the shoulder straps so that the weight of the infant causes the infant support to pull the canopy away from the shoulder straps and hold the canopy in a substantially-extended position that is above and covers the infant compartment and is off of and above the head of the infant.

12. A frameless infant carrier for carrying and supporting an infant on the body of an adult-sized wearer, comprising:

a fabric pouch adapted for receiving an infant, the pouch having a front side and a back side, an infant compartment defined between the front side and the back side, the back side having an upper portion thereof, wherein the back side includes a stiffening member therein to allow the back side to remain in an extended position when the fabric pouch is supporting the infant so that the upper edge of the rear portion is above the head of the infant;

a pair of shoulder straps connected at either end to the pouch, the straps being adapted for encircling the shoulders of the wearer and for maintaining the pouch in a position in which the infant is supported in a substantially-vertical position; and a canopy having first and second opposed edges, the canopy being attached along the first edge to the upper portion of the back side of the pouch and the canopy being selectively and removably attachable along the second edge to the shoulder straps to place the canopy in a position above and covering the infant compartment and above and off of the head of the infant.

13. A frameless infant carrier for carrying and supporting an infant on the body of an adult-sized wearer, comprising:

an infant support adapted for receiving an infant, wherein said infant support includes a fabric pouch, wherein the pouch includes a head bolster formed along an upper edge thereof;

a pair of shoulder straps connected to the infant support, the straps being adapted for encircling the shoulders of the wearer; and a canopy selectively connected between the infant support and at least one of the shoulder straps to provide protection for the infant from adverse elements;

wherein said support is shaped and connected to the shoulder straps in an orientation for carrying the infant in a substantially vertical position, wherein the canopy is connected to the support in a manner which allows the canopy to extend from a location substantially at the top of the support and on the other side of the infant from the wearer, and further wherein said pouch includes a compartment defined therein along a back side and below the head bolster, wherein the canopy is attached to the back side of the pouch, and wherein the compartment is adapted to selectively receive the entire canopy therein when the canopy is not in use.

14. A frameless infant carrier for carrying and supporting an infant on the body of an adult-sized wearer, comprising:

an infant support adapted for receiving an infant, wherein said infant support includes a fabric pouch;

a pair of shoulder straps connected to the infant support, the straps being adapted for encircling the shoulders of the wearer; and a canopy selectively connected between the infant support and at least one of the shoulder straps to provide protection for the infant from adverse elements;

wherein said support is shaped and connected to the shoulder straps in an orientation for carrying the infant in a substantially vertical position, wherein the canopy is connected to the support in a manner which allows the canopy to extend from a location substantially at the top of the support and on the other side of the infant from the wearer, and further wherein the pouch includes a back side with a compartment defined therein, wherein the canopy is attached to the back side of the pouch, and wherein the compartment is adapted to selectively receive the entire canopy therein when the canopy is not in use.

* * * * *